United States Patent [19]

Walter et al.

[11] 4,442,693

[45] Apr. 17, 1984

[54] METHOD OF AND APPARATUS FOR SHAPING NECK AND PROVIDING TERMINAL CURL ON CAN END

[75] Inventors: John Walter, Evergreen Park, Ill.; Charles S. Kubis, Weston, Conn.

[73] Assignee: The Continental Group, Inc., Stamford, Conn.

[21] Appl. No.: 317,644

[22] Filed: Nov. 2, 1981

[51] Int. Cl.[3] ..... B21D 72/00

[52] U.S. Cl. ..... 72/354; 73/379; 413/8; 413/56

[58] Field of Search ..... 413/12, 56, 62, 8; 72/354, 379

[56] References Cited

U.S. PATENT DOCUMENTS 3,434,325 3/1969 Podesta et al. ..... 413/56
3,945,334 3/1976 Ostren et al. ..... 413/12
4,372,720 2/1983 Herdzina et al. ..... 413/56

*Primary Examiner*—Leon Gilden
*Attorney, Agent, or Firm*—Charles E. Brown

[57] ABSTRACT

This relates to the forming of a flared neck terminating in an outwardly turned curl on a metal can end. The metal can end is formed with a terminal tubular portion which is cylindrical. Suitable punch and die tooling is provided for backing up the partially formed can end surrounding the tubular portion and forcing the same into cooperating relation with the curl insert, simultaneously to flare the tubular portion and to form on the end of the tubular portion an out-turned curl. The relationship of the tooling is such that the extent of the flared neck thus formed is accurately controlled. This abstract forms no part of the specification of this application and is not to be construed as limiting the claims of the application.

15 Claims, 7 Drawing Figures

METHOD OF AND APPARATUS FOR SHAPING NECK AND PROVIDING TERMINAL CURL ON CAN END

This invention relates in general to new and useful improvements in die forming apparatus and the method of using the same, and more particularly to the final forming of a tubular neck on a can end wherein the neck terminates in an outwardly turned curl.

This invention particularly relates to the tooling at one station in a punch press operation for the forming of a domed can end wherein the can end has a tubular dispensing neck which terminates in an outwardly turned closure retaining curl. Most specifically, this invention relates to the final forming of a terminal tubular portion of a can end wherein immediately adjacent the tubular portion the can end is reversely folded thereby not permitting the customary curling operation.

In accordance with this invention, the reversely folded portion of the can end is firmly supported by a punch which forces the tubular portion down over a center pin and into the curl die to effect the formation of the desired outwardly turned curl.

Also in accordance with this invention, a base portion of a center pin immediately adjacent the curl die surface is outwardly flared whereby the tubular neck may also be outwardly flared simultaneously with the curl forming operation.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
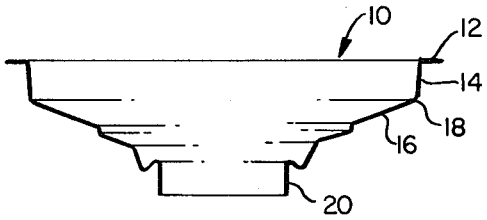
FIG. 1 is a schematic sectional view taken through a partially formed can end which is to be further formed in accordance with this invention.
Figure 3:
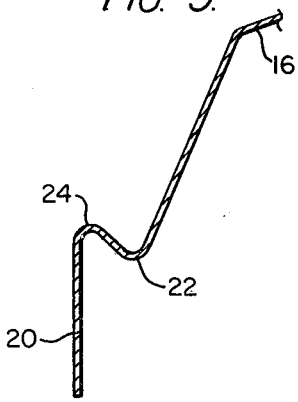
FIG. 3 is an enlarged fragmentary sectional view taken through one half of the center part of the can end of FIG. 1, and shows the configuration of the can end as received for the neck forming and curl forming operation.

Referring now to the drawings in detail, reference is first made to FIGS. 1 and 3 wherein there is illustrated a partially formed can end identified by the numeral 10. The can end 10 at this stage of formation is provided with a peripheral supporting flange 12 which connects to a cylindrical portion 14 which, in turn, is connected to a dome 16 by a radius 18. The illustrated dome 16 is of a stepped configuration and terminates in a terminal tubular portion 20 which at this stage in forming is cylindrical. As is best illustrated in FIG. 3, the dome 16 is reversely folded adjacent the terminal tubular portion 20 to define an upstanding bead 22 and a curl 24 behind which a closure (not shown) is to be locked.

Figure 4:
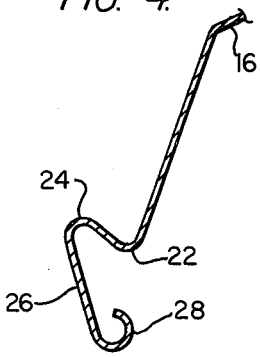
FIG. 4 is an enlarged fragmentary sectional view similar to FIG. 3, and shows the can end after the neck and curl forming operation.
Figure 2:
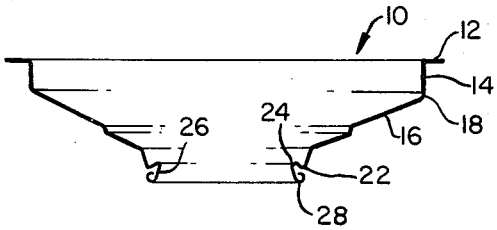
FIG. 2 is a schematic sectional view similar to FIG. 1, and shows the can end after the forming of the flared tubular neck and outwardly turned curl.

The can end 10, as formed in FIG. 1, is to be further formed by radially outwardly flaring the tubular terminal portion 20 and by turning the free end thereof to define a radially outwardly turned curl. Such flared tubular neck is illustrated in FIG. 4 and identified by the numeral 26 while the curl is identified by the numeral 28.

Figure 5:
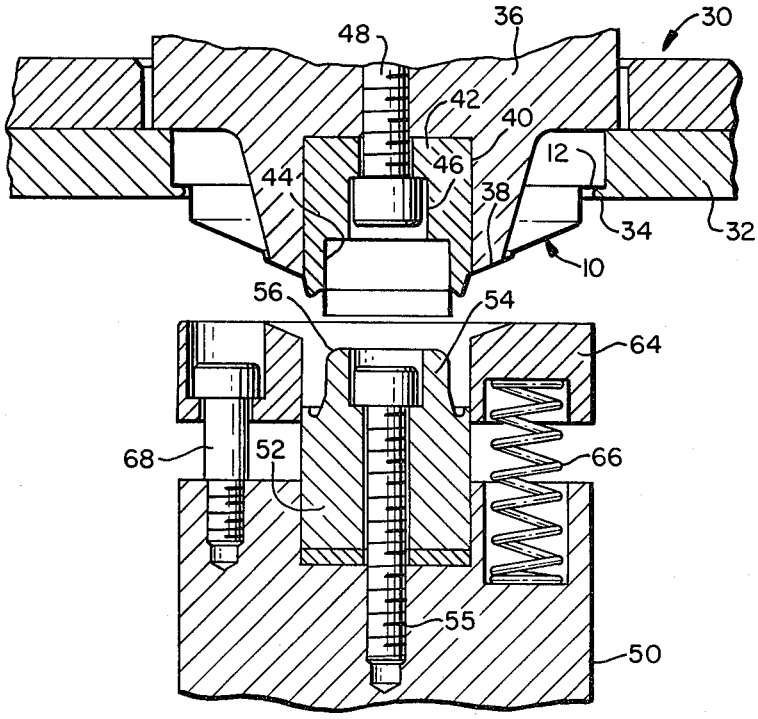
FIG. 5 is a sectional view through the station of the punch press to which this invention relates, and shows the details of the tooling at that station.
Figure 7:
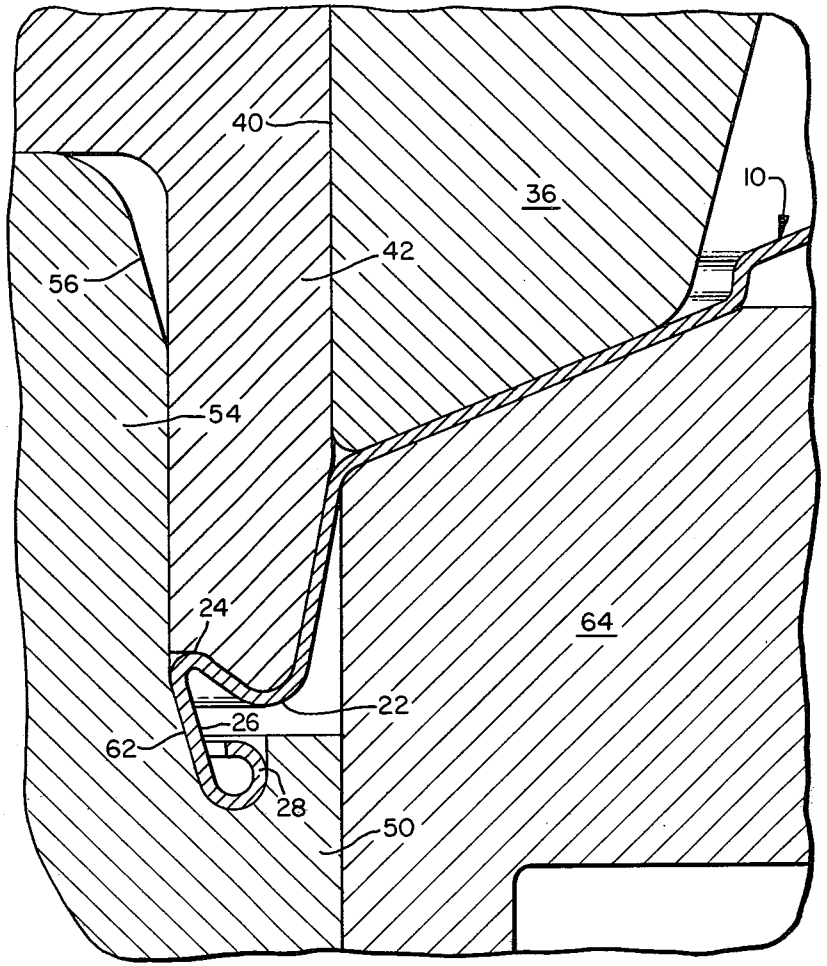
FIG. 7 is an enlarged fragmentary sectional view similar to FIG. 6, and shows the tooling in its final forming position.

Reference is now made to FIG. 5 where there is illustrated the tooling for forming the flared neck portion 26 and the curl 28. This tooling is generally identified by the numeral 30 and includes a nest 32 which is provided with a series of openings each having a lower shoulder 34 on which the flange 12 of a can end 10 seats. It is to be understood that the nest 32 is mounted for movement between stations so that a can end 10 may be successively formed by the nest 32 presenting the can end sequentially to a series of tools. It is further to be understood that the nest 32 is spring loaded and is movable downwardly together with the punch portion of the tooling 30.

The punch portion of the tooling 30 includes a hold-down 36 having a lower surface 38 which is complementary to that surface portion of the can end which is to be engaged thereby. The hold-down 36 is provided with a seat 40 in which there is seated a punch insert 42. The punch insert 42 is provided with a bore 44 of a predetermined diameter and a counterbore 46 in which the head of a fastener 48 fixedly securing the hold-down 36 and the punch 42 to a press ram (not shown) are fixedly secured.

In the illustrated position of FIG. 5, the punch portion of the tooling 30 has moved downwardly into contact with the can end 10 and the hold-down 36 has just engaged the nest 32.

Figure 6:
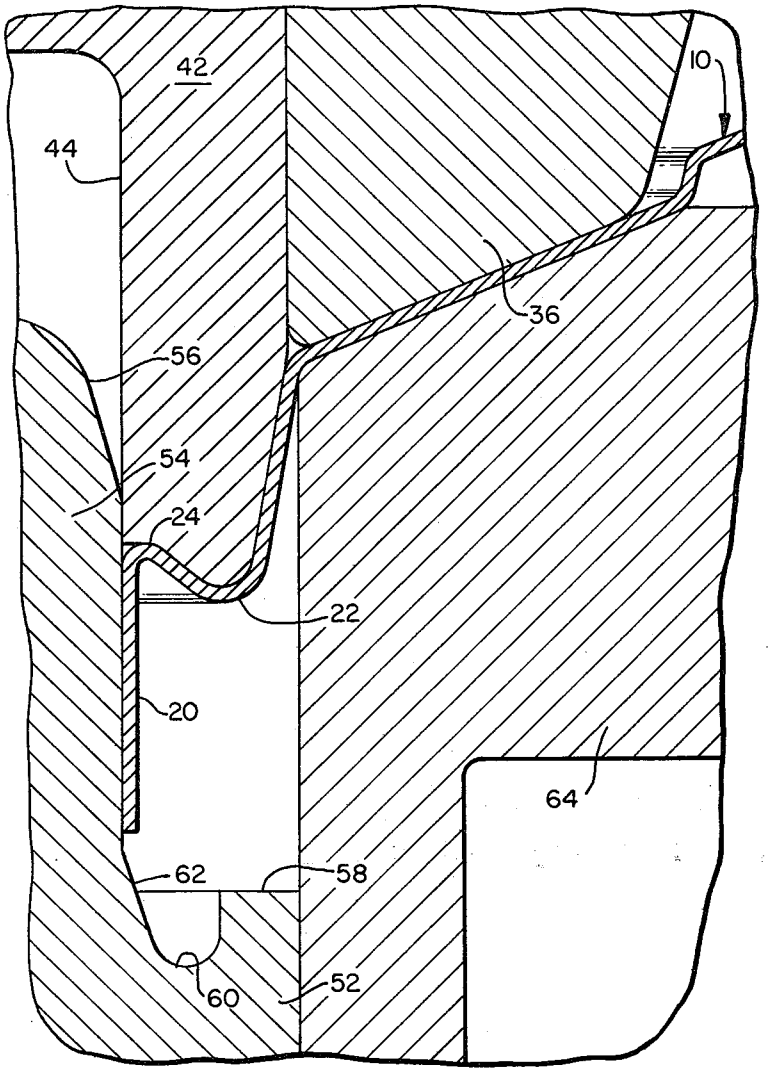
FIG. 6 is an enlarged fragmentary sectional view taken through the tooling of FIG. 5, and with the tooling advancing together to effect the desired forming operation.

The tooling 30 also includes an anvil or like support 50 in which there is seated a curl insert 52 which is secured in place by a fastener 55. The curl insert 52 is provided with a center pin upper portion 54 which has a tapered upper part 56. The curl insert 52 is provided surrounding the center pin 54, as is best shown in FIG. 6, with an annular flange 58 in which there is formed a curl forming groove 60. It is to be noted that the curl insert 52 flared downwardly and radially outwardly from the center pin 54 to the curl forming groove 60, as at 62.

It is also to be noted that the diameter of the bore 44 corresponds to the external diameter of the center pin 54, with the usual clearnace, so that alignment of the punch 42 with the curl insert 52 is assured.

The tooling 30 also includes a stripper ring 64 which surrounds the upper part of the curl insert 52 and is urged upwardly from the anvil 50 by means of a plurality of circumferentially spaced compression springs 66 of which only one is shown. The upward movement of the stripper ring 64 is limited by a set of circumferentially spaced fasteners which function as stops.

As stated above, the punch portion of the tooling 30 is normally disposed above the nest 32 so that the nest 32 may rotate a previously partially formed can end from a prior station to the illustrated station of FIG. 5. With the nest 32 so indexed, the punch portion of the tooling 30 moves downwardly until the hold-down 36 simultaneously engages the nest 32 and the can end, as is clearly shown in FIG. 5. At the same time, the punch 42 has moved down and has engaged the reversely folded portion of the can end which defines the bead 22 and the locking curl 24 in backing relation.

As the punch components of the tooling 30 continue to move downwardly, the nest 32 moves downwardly with them and the previously formed terminal tubular portion 20, which is cylindrical, is led over the center pin 54 as shown in FIG. 6.

As is best shown in FIG. 6, that portion of the can end 10 engaged by the hold-down 36 has come into engagement with the stripper ring 64 and that portion of the can end 10 surrounding the reversely folded portion defining the bead 22 and the locking curl 24 is firmly supported.

As the punch portion of the tooling 30 continues to move downwardly, the stripper ring 64 and the hold-down 36 move downwardly in unison to continue to support the intermediate portion of the can end 10. At the same time the punch 42, guided by the center pin 54, continues to move the central part of the can end downwardly while backing up the central part of the can end and the terminal tubular portion 20. The terminal tubular portion 20 engages the flared portion 62 and the terminal tubular portion 20 begins to flare and continues to be flared as the can end moves downwardly. The free end of the tubular portion 20 engages the curl surface 60 and the terminal end of the tubular portion 20 is outwardly turned to define the outwardly turned curl 28. Thus, in a single operation, without deforming previously formed portions of the can end 10, the can end is provided with a flared neck portion 26 and an outwardly turned terminal curl 28. Further, for reasons which do not form a part of this invention, the curl 28 is accurately portioned relative to the bead 22 and the length of the neck 26 relative to the locking curl 24 is also accurately determined.

It will be seen that in the lowermost portion of the punch 42, the center part of the punch 42 engages the upper end of the center pin 54 and thus positively limits the stroke of the punch and thus the positions of the bead 22 and the locking curl 24 relative to the curl 28.

It will be readily apparent that as the punch portion of the tooling 30 moves upwardly, the spring loaded nest 32, in cooperation with the stripper ring 64, will move the can end 10 upwardly off of the curl insert 50 and thereafter the punch portion of the tooling 30 will separate from the nest 32 leaving the formed can end seated in the nest 32.

Although only a preferred embodiment of the tooling and the method of utilizing the same have been specifically illustrated and described herein, it is to be understood that minor variations may be made in the tooling without departing from the spirit and scope of the invention as defined by the appended claims.

We claim:

1. A method of forming a terminal neck portion and a terminal curl on a metal can end, said method comprising the steps of providing a partially formed can end having a tubular central portion, while supporting the partially formed can end backing up the can end surrounding the tubular central portion, effecting close relative telescoping between the tubular central portion and a die pin, and then forcing the terminal end of the tubular portion into a curling die surrounding the die pin to effect automatic radially outward curling of a terminal end part of said tubular portion.

2. A method according to claim 1 wherein the curling die is located radially outwardly of the terminal end of the tubular portion and the terminal end of the tubular portion is led outwardly from the die pin to simultaneously lead the terminal end of the tubular portion into the curling die and to flare the tubular portion to form the terminal neck portion.

3. A method according to claim 1 wherein prior to the forming steps of claim 1 the partially formed can end is doubly reversely folded adjacent the tubular central portion to define an upstanding bead underlying the resultant curl.

4. A method according to claim 1 wherein prior to the forming steps of claim 1 the partially formed can end is doubly reversely folded adjacent the tubular central portion to define an upstanding bead underlying the resultant curl and a closure locking curl at the inner end of the tubular central portion.

5. A method according to claim 3 wherein means for effecting the backing up of the can end at the time the curl is being formed is seated in the upstanding bead.

6. A method according to claim 3 wherein means for effecting the backing up of the can end at the time the curl is being formed is seated in the upstanding bead and guidedly engaged with the die pin.

7. A method according to claim 4 wherein prior to the forming step of claim 1 means for effecting the backing up of the can end is seated in the upstanding bead and abuts the closure locking curl to apply a direct axial pressure on the tubular central portion of the closure locking curl.

8. A punch and die set for forming a terminal neck portion and a terminal curl on a metal can end from a terminal tubular portion, said punch and die set comprising a curl die having a center pin, said curl die having a forming surface of a configuration for forming a radially outturned curl, a punch axially opposing said center pin and having a free end configurated to back up a can end surrounding the terminal tubular portion thereof, said punch having a hollow end portion of a size to receive in guided relation said center pin, and means for mounting said curl die and said punch to a press structure for relative movement together and apart.

9. A punch and die set according to claim 8 wherein said curl die has its curling surface surrounding the base of said center pin and facing in the same direction as said center pin.

10. A punch and die set according to claim 9 wherein said center pin flares towards said curling surface for simultaneously flaring a can end terminal tubular portion as a curl is formed on the extreme end thereof.

11. A punch and die set according to claim 8 wherein there is telescoped over said curl die a spring loaded stripper ring of an internal diameter to receive a lower portion of said punch.

12. A punch and die set according to claim 8 wherein there is telescoped over said curl die a spring loaded stripper ring of an internal diameter to receive a lower portion of said punch, and there is a hold-down surrounding said punch and cooperable with said stripper ring for clamping a can end intermediate portion surrounding that portion engaged by said punch.

13. A punch and die set according to claim 12 wherein there is a nest for engaging a peripheral portion of a can end, and said punch is dimensioned to firmly engage a can end set in said nest.

14. A punch and die set according to claim 8 wherein there is a nest for engaging a peripheral portion of a can end, and said punch is dimensioned to firmly engage a can end set in said nest.

15. A method according to claim 3 wherein means for effecting the backing up of a can end at the time the curl is being formed is seated in the upstanding bead, is hollow, and is guidedly engaged with the die pin.

* * * * *